US006149485A

United States Patent [19]

Christiansen

[11] Patent Number: 6,149,485

[45] Date of Patent: Nov. 21, 2000

[54] COLLAPSIBLE BUILDING BLOCK FOR ERECTING TOY BUILDINGS THAT FALL DOWN FLAT

[76] Inventor: Lyle J. Christiansen, 701 Imperial Dr., Morris, Minn. 56267

[21] Appl. No.: 09/473,861

[22] Filed: Dec. 28, 1999

[51] Int. Cl.[7] ..... A63H 33/06

[52] U.S. Cl. ..... 446/4; 445/115; 445/478

[58] Field of Search ..... 446/4, 85, 108, 446/115, 478

[56] References Cited

U.S. PATENT DOCUMENTS

| | | | |
|---|---|---|---|
| 276,539 | 4/1883 | Reed . | |
| 298,633 | 5/1884 | Snow . | |
| 1,181,825 | 5/1916 | Bartelt . | |
| 1,487,102 | 3/1924 | Hodgeson . | |
| 2,131,349 | 9/1938 | Kreider . | |
| 2,723,124 | 11/1955 | Martin . | |
| 2,988,844 | 6/1961 | Frimberger . | |
| 3,203,124 | 8/1965 | Stoessel | 40/124 |
| 4,488,373 | 12/1984 | Glickson et al. . | |
| 4,650,437 | 3/1987 | Sitkus | 446/128 |
| 5,074,819 | 12/1991 | Stadnyk . | |
| 5,215,490 | 6/1993 | Szoradi | 446/115 |
| 5,354,224 | 10/1994 | Ishiyama | 446/117 |
| 5,482,490 | 1/1996 | Weldon-ming | 446/75 |
| 5,542,870 | 8/1996 | Westersund | 446/75 |

*Primary Examiner*—Jacob K. Ackun
*Assistant Examiner*—Jeffrey D. Carlson

[57] ABSTRACT

A collapsible toy building block with strong board members. Base board (12) and roof board (10) interconnect loosely with frame boards (24)(24A). Frame boards set loosely in channel (26) that is formed by, short in length, projecting spacers (18) that run parallel to flanges (14),(16) that are along the front and back ends of base (12) and roof (10). A building block of this construction can be combined with other identical building blocks or a variety of other building blocks, that have the same widths, to build toy buildings of many different configurations. The loosely fitting members, of a building block of this type, permit a building block or toy building constructed of building blocks to be knocked down flat by an outside force.

2 Claims, 2 Drawing Sheets

COLLAPSIBLE BUILDING BLOCK FOR ERECTING TOY BUILDINGS THAT FALL DOWN FLAT

CROSS-REFERENCE TO RELATED APPLICATIONS

Not applicable.

BACKGROUND

1. Field of Invention

This invention relates to a building block, that falls down flat when struck by an outside force, for building toy houses, skyscrapers, castles and other toy structures.

2. Description of Prior Art

Previously, building toy houses or toy skyscrapers out of cards took high dexterity. And if one was successful, a slight bump or door slam would cause a structure to collapse.

A game or toy for building card houses was proposed by U.S. Pat. No. 1,487,102 (1924). This patent consists of cards with perforations and pegs which fit through said perforations to hold cards of the building together.

Frimberger's Modular Toy Structure (U.S. Pat. No. 29288844) Describes a modular component unit or modular panel unit. Throughout the description it refers to a statement: Assembled by frictional engagement with one another pieces or some similar description stating the words: Frictional engagement. This leads one to believe that a structure containing these components would stand fairly stable and if struck by an outside force would not fall down flat.

Whereas my invention of a toy building block so constructed that wherein the frame boards of said building block interconnect loosely on the base piece of said building block and the roof piece interconnect loosely on the frame boards of said building block. When this said building block is struck by an outside force it falls down flat. It is not held together by frictional force. This invention had features to hold cards together. The inventor seems to have been mainly interested in card structures that would not fall down readily.

SUMMARY

In accordance with the present invention of a building block of loosely-fitting, interconnecting board members that fall down flat when struck by an outside force.

OBJECTS AND ADVANTAGES

Accordingly, several objects and advantages of my invention are:

(a) to provide a building block that falls down flat when struck by an outside force.

(b) to provide a building block that can be set on top of other building blocks to build a variety of toy buildings.

(c) to provide a building block that has plain frame boards that accept an unlimited number of designs there-on.

(d) to provide a building block that allows one to build said building block with a minimum amount of dexterity.

still further objects and advantages will become apparent from a consideration of the ensuing description and drawings.

DRAWINGS FIGURES

In the drawings, identical parts have the same number.

REFERENCE NUMERALS IN DRAWINGS

| | |
|---|---|
| 10 Roof | 22 Base Fillets |
| 12 Base | 24 Frame Boards |
| 14 Base Flanges | 24A Other Frame Boards |
| 16 Roof Flanges | 26 Channel |
| 18 Spacers | |
| 20 Roof Fillets | |

Figure 1:
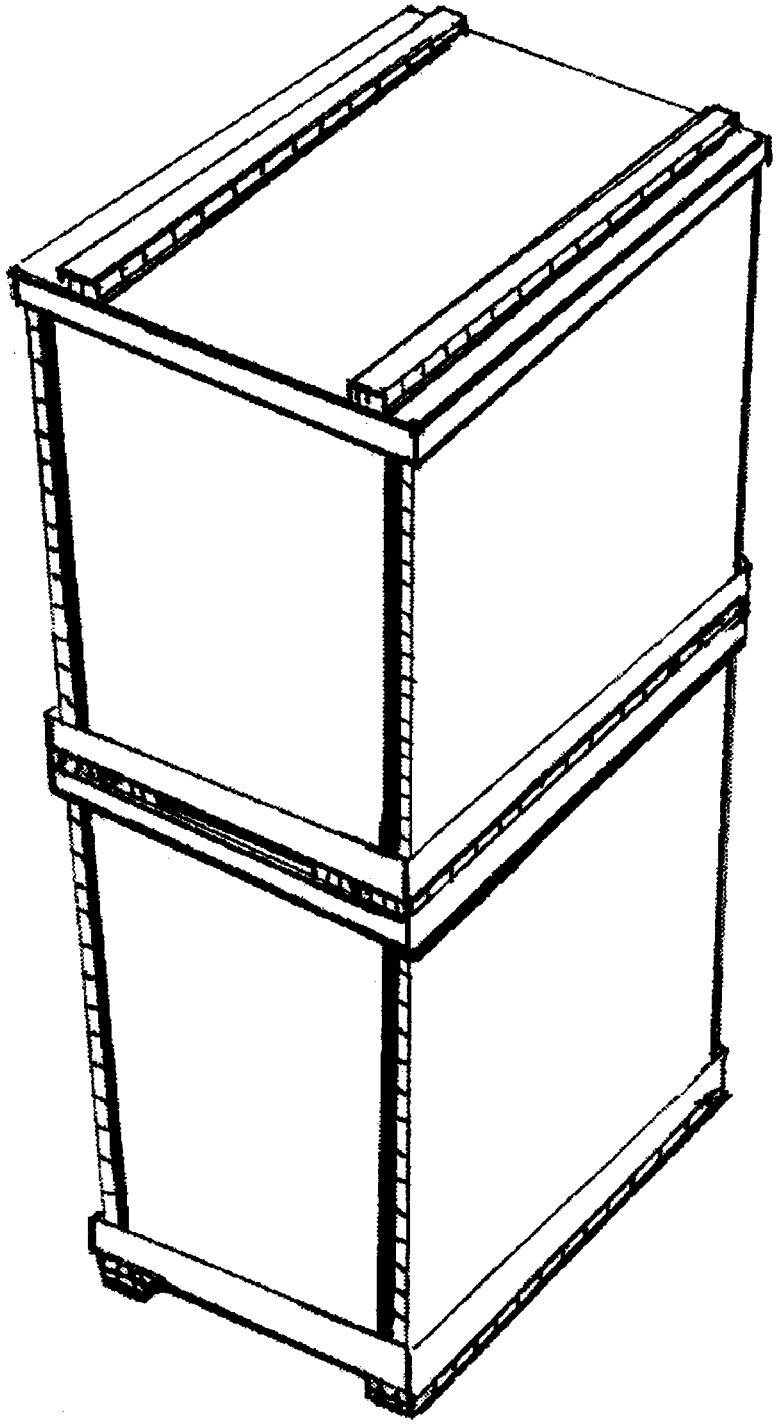
FIG. 1 shows two building blocks stacked.
Figure 2:
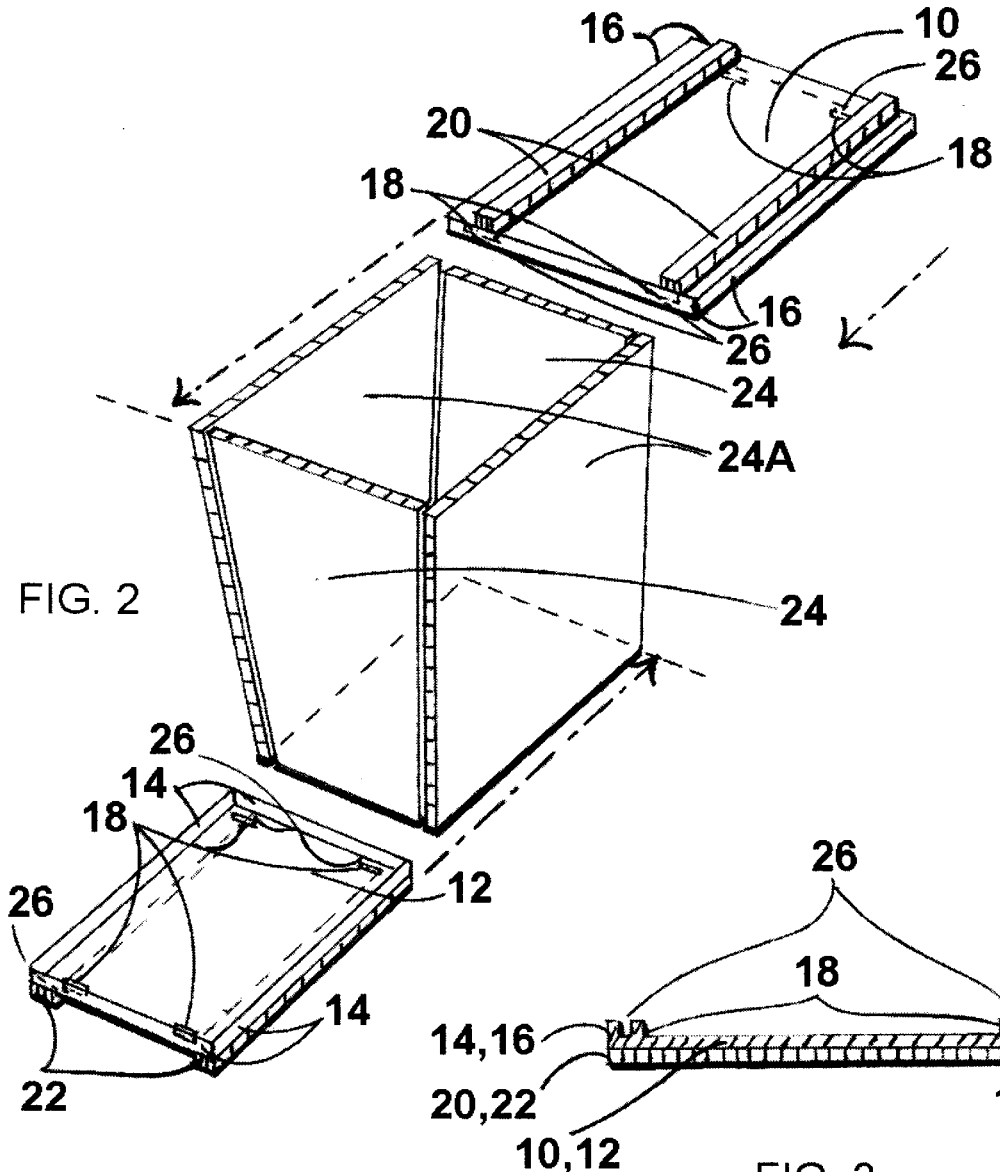
FIG. 2 shows a perspective view of a somewhat exploded view of a building block.

DESCRIPTION-FIG. 1 and FIG. 2-Preferred Embodiment

A preferred material used, in the production of all parts of the present invention, is a strong plastic.

FIG. 1 shows base 12 of the upper building block interconnecting with roof 10 of the lower building block. Fillets 22 that run front to back on base 12 straddle fillets 20 that run front to back on roof 10.

FIG. 2 shows flanges 14, 16 that are around the perimeter of base 12 and roof 10. Base 12 and roof 10 also have, short in length, projecting spacers 18 that run parallel to flanges 14, 16 that are along the front and back ends of base 12 and roof 10.

Figure 3:
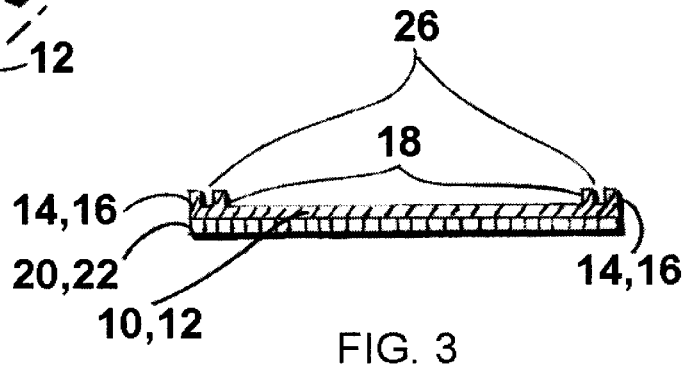
FIG. 3 shows a side view of boards 10, 12 while lying down flat.

FIG. 3 shows channel 26 formed by parallel flanges 14, 16 and parallel, short in length, projecting spacers 18. Channel 26 is slightly wider than the thickness of frame boards 24, 24A.

Vertical boards 24, 24A form the main body of a building block. Frame Boards 24 set loosely inside frame boards 24A at the corners where frame boards 24, 24A meet. In this case frame boards 24, 24A form a rectangular shape.

Advantages

From the description above advantages, of using strong plastic, in the production of this invention, become evident.

(a) Strong plastic make parts long-lasting and said parts hold their original shape even after hard and repetitive use. Varied surface textures of frame boards also are possible.

(b) A variety of designs are possible for surface decorations on frame boards.

Operation—FIGS. 1,2

The drawing in FIG. 1 shows two identical building blocks stacked one on top of the other. One can stack additional building blocks on top of these. Other building blocks can be set alongside other building blocks also, so that one's imagination can be used to create numerous configurations of toy buildings.

It is entertaining to build a toy building and it is also entertaining to knock a toy building down flat. Blows delivered to a toy building from toy catapults, toy cannons, wrecking balls, toy bulldozers are examples.

In FIG. 2 arrows show movement of base 12 and roof 10 to locate base 12 and roof 10 directly below and above frame boards 24, 24A. To accomplish interconnections, frame boards 24, 24A set in channels 26 of base 12 and roof 10. Frame boards 24A are of a length to set between flanges 14, 16 that run front to back on base 12 and roof 10. Frame boards 24 are of a length to set between frame boards 24A as they stand in the FIG. 2 drawing. Fillets 20 are located just inwards from the sides of roof 10. Fillets 22 are located on the very edges of the sides of base 12. Therefore, when one building block is placed on top of another building block, said fillets of roof 10 and base 12 interconnect in a straddling way, thus allowing the stacked building blocks to move backwards when hit by an outside force and to fall off the building block below it. Said fillets on each building block restrict the said building block from moving sideways when struck by an outside force thus preventing remaining building blocks from condensing on each other in a pinching movement. Thus, remaining building blocks are free to fall off the structure in their turn as they are struck by an outside force.

Conclusion, Ramifications, and Scope

Accordingly, the reader will see that a building block, as shown in FIG. 2, is a structure with loosely-fitting, separate parts that readily falls down flat when struck by an outside force. Identical building blocks are used in conjunction with other building blocks to build a variety of toy buildings. Many different shapes formed by a different number of frame boards are incorporated in a frame structure, such as rectangular, pentagonal, triangular, hexagonal, circular, for example. Base's 12 and roof's 10 then have these same shapes so that they interconnect over vertical standing frame boards 24, 24A.

The building block shown in FIG. 2 is one type of structure. Another variation of the structure is a building block with a set of teepee boards between a base and roof board. The base board has a stopper strip across its center to stop the center legs of the teepee boards from moving wider apart. Flanges around the perimeter of its base and roof parts set over the teepee parts, as in my preferred structure. I found this teepee-braced building needed more dexterity to erect.

Another building block with frame boards joined by hinges at the corners where the frame boards meet makes a sturdy frame. The base and roof boards also have flanges around their perimeters to that they interconnect over the frame boards with hinges. I found this type of building block does not fall down flat when it is knocked down by an outside force.

Thus, the scope of this invention should be determined by the appended claims and their legal equivalents, rather than by the examples given.

I claim:

1. A toy construction block comprising:

a base board, roof board and four frame boards;

the top of the base board and the bottom of the roof board each having parallel flanges and spacers defining a channel about the board periphery;

the four frame boards loosely fitting between the channels so that a six sided building block can be built;

the top of the roof and the bottom of the base each having a set of two parallel fillets, one set of fillets being spaced wider than the other set of fillets so that another said building block can be stacked with the building block wherein the sets of fillets straddle each other; and the construction block being capable of being knocked down flat by an outside force.

2. The toy construction block of claim 1 wherein the four frame boards are planar.

* * * * *